US007628696B2

(12) United States Patent
Gauselmann

(10) Patent No.: US 7,628,696 B2
(45) Date of Patent: Dec. 8, 2009

(54) GAMING DEVICE WITH NETWORK PORT FOR SELECTING JACKPOT FREQUENCY

(75) Inventor: Michael Gauselmann, Espelkamp (DE)

(73) Assignee: Atronic International GmbH, Lübbecke (DE)

( * ) Notice: Subject to any disclaimer, the term of this patent is extended or adjusted under 35 U.S.C. 154(b) by 1151 days.

(21) Appl. No.: 10/195,118

(22) Filed: Jul. 12, 2002

(65) Prior Publication Data

US 2004/0009808 A1 Jan. 15, 2004

(51) Int. Cl.
*A63F 9/24* (2006.01)

(52) U.S. Cl. ..... 463/26; 463/42

(58) Field of Classification Search ..... 463/16–20, 463/25–27, 46, 42; 273/138.1, 138.2, 139, 273/143 R; 283/903
See application file for complete search history.

(56) References Cited

U.S. PATENT DOCUMENTS

| | | | | |
|---|---|---|---|---|
| 4,700,948 | A * | 10/1987 | Okada | 273/143 R |
| 5,016,880 | A * | 5/1991 | Berge | 463/27 |
| 5,048,833 | A * | 9/1991 | Lamle | 463/27 |
| 5,344,144 | A * | 9/1994 | Canon | 463/27 |
| 5,393,067 | A * | 2/1995 | Paulsen et al. | 273/292 |
| 5,564,700 | A | 10/1996 | Celona | |
| 5,743,798 | A * | 4/1998 | Adams et al. | 463/17 |
| 5,788,573 | A * | 8/1998 | Baerlocher et al. | 463/16 |
| 5,876,284 | A * | 3/1999 | Acres et al. | 463/25 |
| 5,882,259 | A * | 3/1999 | Holmes et al. | 463/13 |
| 6,015,347 | A * | 1/2000 | Maahs et al. | 463/27 |
| 6,033,307 | A * | 3/2000 | Vancura | 463/20 |
| 6,089,980 | A * | 7/2000 | Gauselmann | 463/27 |
| 6,179,711 | B1 * | 1/2001 | Yoseloff | 463/25 |
| 6,203,429 | B1 * | 3/2001 | Demar et al. | 463/20 |
| 6,210,275 | B1 * | 4/2001 | Olsen | 463/16 |
| 6,224,482 | B1 | 5/2001 | Bennett | |
| 6,234,897 | B1 * | 5/2001 | Frohm et al. | 463/20 |
| 6,312,334 | B1 * | 11/2001 | Yoseloff | 463/25 |
| 6,375,189 | B1 * | 4/2002 | Jones | 273/292 |
| 6,419,578 | B1 * | 7/2002 | Moody et al. | 463/13 |
| 6,491,583 | B1 * | 12/2002 | Gauselmann | 463/20 |

(Continued)

FOREIGN PATENT DOCUMENTS

| | | |
|---|---|---|
| CA | 2270062 | 6/2003 |

(Continued)

OTHER PUBLICATIONS

"(Big) Money Game", 1973 as printed from http://gscentral.net/money.htm, pp. 1-4.*

(Continued)

*Primary Examiner*—Corbett B Coburn
(74) *Attorney, Agent, or Firm*—Patent Law Group LLP; Brian D. Ogonowsky

(57) ABSTRACT

At least one gaming machine in a network of gaming machines includes displays for a main game and a bonus game. The bonus game is activated when a particular outcome of the main game is achieved. A jackpot that is common to a plurality of the gaming machines in the network may be awarded when certain criteria are achieved in the bonus game. The certain criteria may occur entirely within the bonus game, or may be distributed between the main game and the bonus game. The certain criteria may be, for example, the display of a particular symbol or symbol combination, or a particular outcome of the bonus game.

1 Claim, 3 Drawing Sheets

U.S. PATENT DOCUMENTS

| | | | | |
|---|---|---|---|---|
| 6,592,458 | B1 * | 7/2003 | Ho | 463/17 |
| 6,702,674 | B1 * | 3/2004 | De Bruin et al. | 463/26 |

FOREIGN PATENT DOCUMENTS

| | | | |
|---|---|---|---|
| DE | 19842832 | A1 * | 3/2000 |
| WO | WO 9749073 | A1 * | 12/1997 |
| WO | WO 99/10849 | | 3/1999 |
| WO | WO 00/17825 | | 3/2000 |
| WO | WO 01/83062 | A1 | 11/2001 |

OTHER PUBLICATIONS

Post, "Slot Machines of Yesteryear Operator's Companion", 1979, Post-Era Books, pp. 124-125 (4 total pages including one page of book's cover, two pages of bibliographic pages and one page incluidng pp. 124-125).*

European Search Report, 1 page.

* cited by examiner

GAMING DEVICE WITH NETWORK PORT FOR SELECTING JACKPOT FREQUENCY

BACKGROUND

1. Field of Invention

This invention relates to gaming machines and, in particular, to gaming machines with bonus games and progressive jackpots.

2. Description of Related Art

Gaming machines, such as slot machines, video poker machines, and the like, have been a cornerstone of the gaming industry for several years. Generally, the popularity of such machines with players is dependent on the likelihood (or perceived likelihood) of winning money at the machine.

It is known to combine the main games of gaming machines with secondary games, such as progressive jackpots or bonus games, that are triggered occasionally from the main game. Secondary games may pay out less frequently than the main game, but often secondary games pay large jackpots compared to the main game, thereby increasing the perceived likelihood of winning a large amount and the appeal to a player. Since secondary games may pay large jackpots, if a secondary game is won too frequently, the gaming machine will not be profitable. Thus, the frequency with which secondary games are won must be controlled in order to maintain the profitability of the gaming machine.

SUMMARY

In accordance with embodiments of the invention, at least one gaming machine in a network of gaming machines includes one or more displays for a main game and a bonus game. The bonus game is activated when a particular outcome of the main game is achieved. A jackpot that is common to all the gaming machines in the network may be awarded when certain criteria are achieved in the bonus game. The certain criteria may occur entirely within the bonus game, or may be distributed between the main game and the bonus game. The certain criteria may be, for example, the display of a particular symbol or symbol combination in the bonus game, or another particular outcome of the bonus game.

DETAILED DESCRIPTION

A gaming machine according to embodiments of the invention includes a main game and a bonus game that is activated when predefined conditions in the main game occur. The gaming machine is part of a network of interconnected gaming machines and participates in a progressive game, where a percentage of wagers from all machines in the network is accumulated in a single jackpot. The award of a jackpot in the progressive game may be triggered by predefined conditions in the bonus game, or by predefined conditions in both the main game and the bonus game. In other embodiments, there may be multiple progressive jackpots.

Although the invention can typically be implemented by installing a software program in most types of modem video gaming machines, where the main game, bonus game, and progressive jackpot are displayed on a single video screen, one particular gaming machine platform having a "top box" specifically designed for conducting the bonus game and displaying the progressive jackpot will be described in detail.

Figure 1:
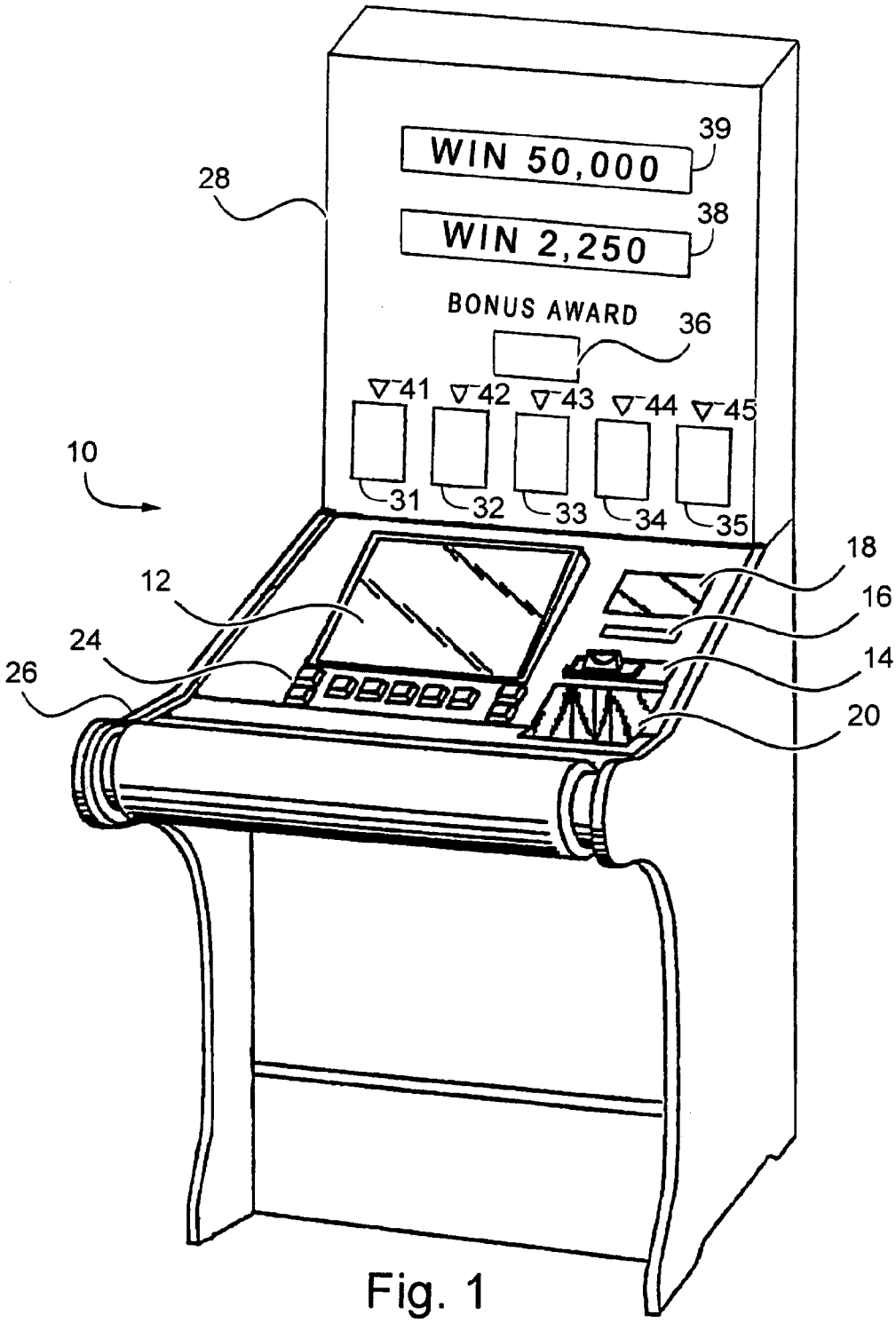
FIG. 1 illustrates a gaming machine having a console and a top box, according to an embodiment of the present invention.

FIG. 1 is a perspective view of a gaming machine 10 that incorporates the present invention. Gaming machine 10 includes console 26, where the main game is played, and top box 28, where the bonus game is played. Console 26 includes a display 12 that may be a thin film transistor (TFT) display, a liquid crystal display (LCD), a cathode ray tube (CRT), or any other type of display. Display 12 may include a touch screen for converting a player's touching of areas of the screen into commands for the game program to carry out. Display 12 may also be a window revealing rotating reels.

A coin slot 14 accepts coins or tokens in one or more denominations to generate credits within machine 10 for playing games. An input slot 16 is also provided for receiving either bills, machine readable printed tickets, cashless gaming cards, smart cards, or other types of media for generating credits within machine 10. A display 18 may identify instructions to the player for depositing money or monetary equivalents into machine 10.

A coin tray 20 is provided for receiving coins or tokens from a hopper upon a win or upon the player cashing out.

Player control buttons 24 include any buttons needed for the play of the particular game or games offered by machine 10 including, for example, a bet button, a repeat bet button, a play two-ways button, a spin reels button, a deal button, hold card buttons, a draw button, a maximum bet button, and cash-out button, and any other suitable buttons for the main game offered by machine 10. Buttons 24 may be replaced by a touch screen with virtual buttons.

Top box 28 includes windows 31, 32, 33, 34, and 35, where the bonus game is played, and display 36 for displaying the amount won in the bonus game. Any other type of bonus game can be played. One or more displays 38 and 39 display the amount in one or more progressive jackpots.

Figure 2:
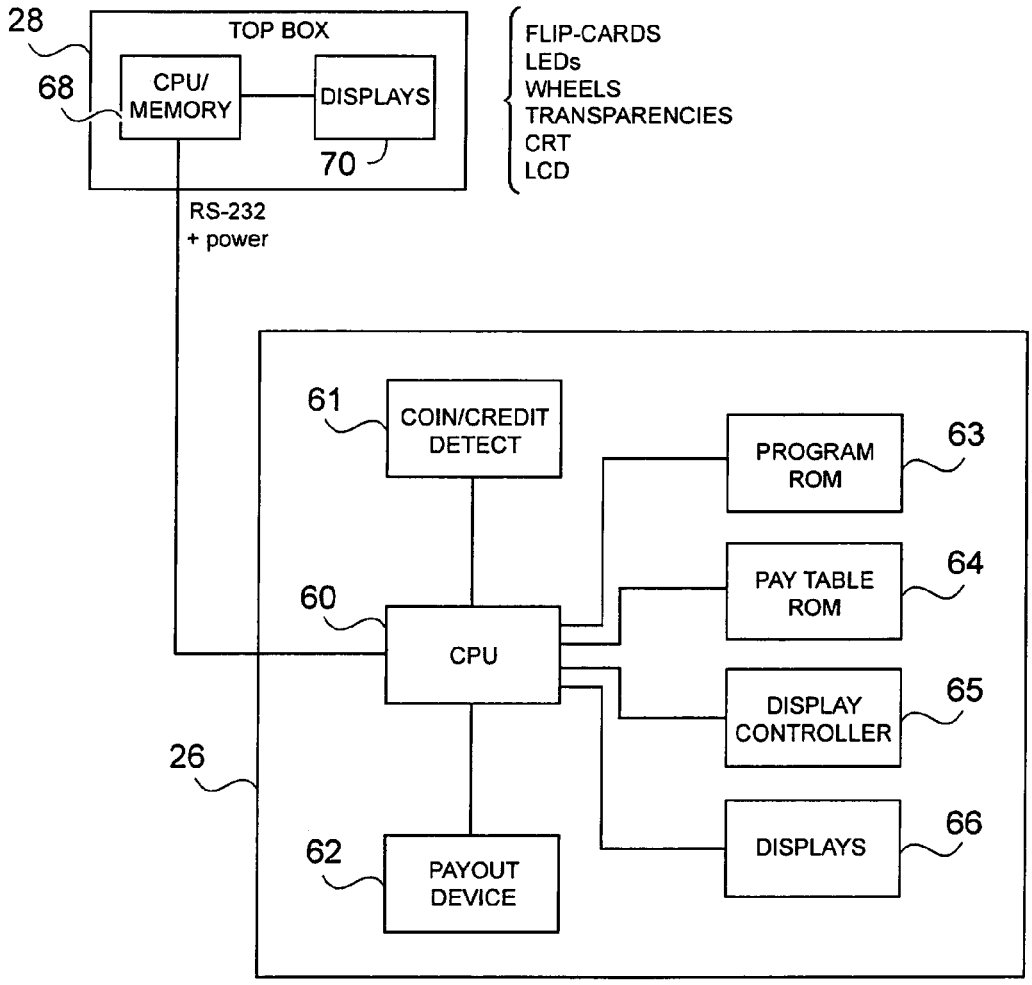
FIG. 2 illustrates various components of the console and top box of FIG. 1.

FIG. 2 is a block diagram illustrating basic functional blocks in console 26 and in top box 28 of machine 10. A CPU 60 runs a gaming program stored in a program ROM 63. CPU 60 also uses a conventional RAM. A coin-credit detector 61 generates credits to play the game. A payout device 62 pays out an award to the player in the form of coins upon termination of the game or upon the player cashing out. A payout may also be in the form of a coded paper ticket, credits on a smart card or magnetic strip card, or in any other form. A pay table ROM 64 receives signals corresponding to the outcome of the game and identifies the award to be paid to the player by the payout device 62. A display controller 65 receives commands from CPU 60 and generates signals for any display 66 (such as display 12 in FIG. 1). If a display is a touch screen, player commands may be input through the display screen to CPU 60.

Upon a special combination of symbols being generated in the main game (or upon any other special outcome of the main game), signals from the CPU 60 are transmitted via, for example, an RS-232 interface to electronics located in the top box 28 for carrying out the bonus game. By separating the electronics for the top box 28 from the electronics in the lower portion of the machine, the lower portion of the machine may be made generic so it can be used in combination with various other types of top boxes conducting different forms of bonus games. Additionally, the programming of the bonus game may be changed independently of the programming for the main game.

In one embodiment, upon the special outcome of the main game, the CPU 60 randomly generates signals for the five display areas 31-35 and transmits these signals to CPU 68 in the top box 28. The CPU 68 (coupled to any type of RAM and ROM containing the bonus gaming program) then carries out the bonus gaming routine contained in the memory to control the various displays in the top box 28. Any other division of the bonus game function may be made between CPU 60 and CPU 68.

The displays for areas 31-35 in the top box 28 are referred to as displays 70 in FIG. 2. The various displays 70 may include flip-cards, LEDs, wheels, transparencies, CRTs, LCDs or any combination of such displays or any other known displays. Flip cards are of the type well known in the art of gaming, digital clocks, and signs, where thin printed cards pivoting around a common axis are flipped by a motor until the selected card is displayed. Such flip card displays are commercially available, as are the other types of displays. Additionally, in one embodiment, the top box 28 may have control buttons for the player, where the bonus game requires player input.

Figure 3:
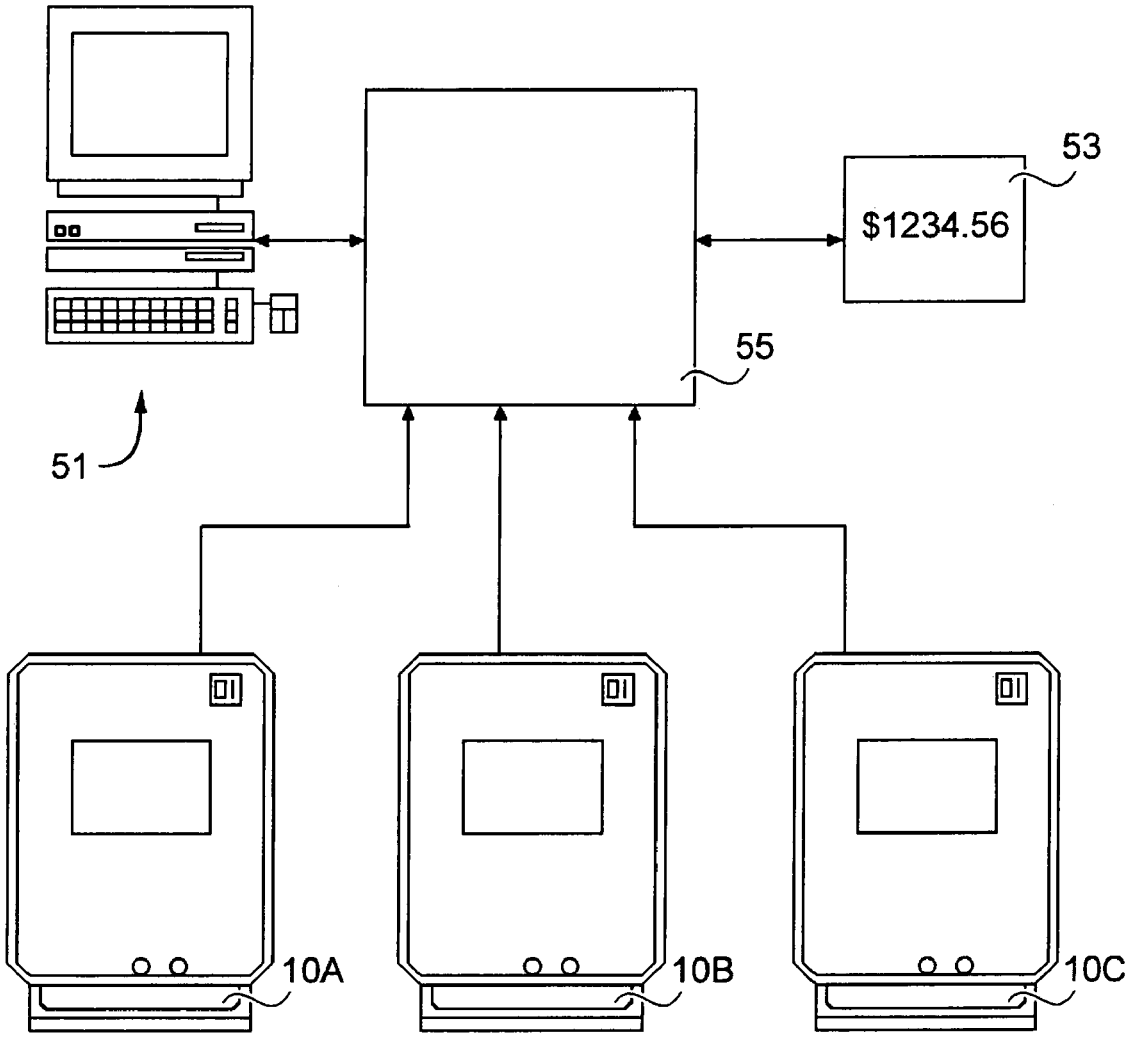
FIG. 3 illustrates a network of connected gaming machines.

The gaming machine of FIGS. 1 and 2 may be connected to a network of other gaming machines in a progressive jackpot gaming system. FIG. 3 is a block diagram of a network of interconnected gaming machines. The network illustrated in FIG. 3 may be located in a single location or spread over multiple locations and may be connected to other networks. The network of FIG. 3 includes a number of gaming machines 10A, 10B, and 10C of any type. Gaming machines 10A-10C are connected to a conventional multiplexer/demultiplexer (MUX) 55 that serves to communicate with all the gaming machines in the network. In one embodiment, the communication link between the gaming machines, MUX 55, and jackpot display 53 is a serial RS-422 communication link, and gaming machines 10A-10C are connected in a star pattern. A central server computer 51 runs a computer program that controls the network, including jackpot display 53. A suitable computer program for controlling the network would be understood by those skilled in the art.

Jackpot display 53 may be viewable by all players in the same location playing gaming machines connected to the network. Multiple jackpot displays may be used, such as when parts of the network are in different physical locations or if each gaming machine displays the jackpot. All jackpot displays connected to the network have the same information displayed.

In one embodiment, the main and bonus games are played, and the progressive jackpot is awarded as follows. The player places a bet and starts the main game by pressing one or more of buttons 24 on console 26 in FIG. 1. The main game may be virtually any type of game where at least one of the outcomes of the main game activates or enables playing of the bonus game, such as real or simulated rotating reels, card games, or other games of chance. A typical main game is a plurality of rotating reels displayed on the video display 12 whose stop positions are determined by a pseudo random generator. The bonus game in top box portion 28 may be activated when a special symbol or combination of symbols is the outcome of the main game. The special symbol or combination of symbols may be advertised on display 12 or in top box 28. When the special symbol or combination of symbols is the outcome of the main game, hardware or software in console 26 instructs top box 28 to begin the bonus game.

When the bonus game is activated, parts of top box 28 may gradually become illuminated, drawing the player's attention to top box 28. Five indicia may then be displayed in display areas 31-35, either automatically or after the player presses a button. Each indicia may be, for example, a bonus amount (money or credits), a multiplier, or a symbol. A combination of indicia types may also be displayed. Lights 41-45 begin turning on and off, either randomly or in sequence. Lights 41-45 then stop turning on and off, leaving on one of lights 41-45 identifying the player's prize. Lights 41-45 may stop turning on and off automatically or at the player's prompting. The player's bonus prize may then be displayed in display 36.

Different special symbols or symbol combinations may cause the player to win one or more progressive jackpots displayed on displays 38 and 39 of FIG. 1 and display 53 of FIG. 3.

It is known to trigger the award of a progressive jackpot from the main game. In conventional games where the main game is rotating reels, a progressive jackpot may be awarded when all the reels display a special symbol. The special symbol is typically the symbol associated with the highest payouts. If the progressive jackpot is triggered from the main game by all reels displaying the special symbol, each of the reels must have one or more special symbols. If the special symbol has additional functions besides being the jackpot symbol, such as being a wild card or triggering other awards in the game, the design of the game becomes very complicated. The designer must not cause the machine to pay out too frequently on the main game, which makes the machine unprofitable. When the progressive jackpot is triggered from the main game, it is difficult to adjust both the pulls-to-hit ratio of the progressive jackpot game and the return-to-player-percentage of the main game such that the machine is appealing to players, yet still profitable.

In accordance with one embodiment of the invention, the payment of one or more progressive jackpots is triggered from the bonus game, rather than the main game. For example, in the bonus game described above, the progressive jackpot may be awarded when each of display areas 31-35 displays the same indicia, which may be the same as the special symbol in the main game, or when a progressive jackpot trigger symbol is selected by lights 41-45 as the outcome of the bonus game. When the progressive jackpot is triggered from the bonus game, the pulls-to-hit ratio of the progressive jackpot can be more closely controlled, without affecting the payout frequency of the main game. The lower boundary of the pulls-to-hit ratio of the progressive jackpot is the frequency with which the outcome of the main game triggers the bonus game, and the upper boundary is limitless. In one embodiment, the upper boundary of pulls-to-hit ratio of the progressive jackpot is dictated by regulations in the jurisdiction where the machine is located. The pulls-to-hit ratio of the progressive jackpot may be configured by downloading the appropriate ratio to all the gaming machines in the network from, for example, server computer 51 of FIG. 3. Thus, the pulls-to-hit ratio may be adjusted without changing hardware or software within each of the gaming machines.

In one embodiment, a port in gaming machine 10 receives a signal from the network indicating the frequency with which the jackpot is to be awarded, whereby a microprocessor in a gaming device generates an outcome in the bonus game to award the jackpot pursuant to the signal from the network.

In accordance with another embodiment of the invention, the payment of one or more progressive jackpots is triggered by a combination of elements in both the main game and the bonus game. For example, the progressive jackpot may be awarded when all the reels in the main game display the special symbol, and display areas 31-35 in the bonus game all display the special symbol during the bonus game. Since the progressive jackpot requires that a condition in the bonus game be satisfied, this embodiment offers the same balance between trigger frequency and machine profitability as a progressive jackpot triggered strictly from the bonus game. In addition, since the progressive jackpot is triggered in two stages, the machine increases player excitement and makes the machine more appealing. For example, in the first stage, the player plays the main game, and the outcome of the main game is each of the reels displaying the special symbol. At this point, the player knows he or she has a chance to win the progressive jackpot, but still has to fulfill certain conditions in the bonus game. The game becomes exciting because the player feels that the progressive jackpot is within reach.

In some embodiments, the gaming machine may participate in multiple progressive jackpots, each triggered by the same or different triggers. For example, in the device illustrated in FIG. 1, a first progressive jackpot, available when the player makes a small bet, may be displayed in display area 38. A second, larger progressive jackpot, available when the player makes a larger bet, may be displayed in display area 39. Or, a first progressive jackpot may be awarded when the player achieves the required trigger in the bonus game, and a second, larger progressive jackpot may be awarded when the player achieves the required triggers in both the main game and the bonus game.

In another embodiment, the outcome of the main game may trigger one progressive jackpot, and the outcome of the bonus game may trigger another progressive jackpot.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is claimed is:

1. A gaming device capable of being connected to a network, the gaming device comprising:

one or more displays for displaying a main game and a bonus game, the main game having a plurality of possible outcomes, at least one of the outcomes enabling a bonus game, at least one of the outcomes of the bonus game causing the award of at least a portion of a jackpot common to a plurality of gaming machines in the network; and a port for receiving a signal from the network indicating the frequency with which the jackpot is to be awarded, whereby a microprocessor in the gaming device generates an outcome in the bonus game to award the jackpot pursuant to the signal from the network.

* * * * *